US006663449B1

(12) United States Patent
Quaeck

(10) Patent No.: US 6,663,449 B1
(45) Date of Patent: Dec. 16, 2003

(54) LOW FRONTAL AREA, INBOARD, THROUGH-HULL PROPELLER DRIVE

(76) Inventor: Manfred Quaeck, 1515 210$^{th}$ NE., Sammamish, WA (US) 98074

( * ) Notice: Subject to any disclaimer, the term of this patent is extended or adjusted under 35 U.S.C. 154(b) by 11 days.

(21) Appl. No.: 10/155,335

(22) Filed: May 24, 2002

(51) Int. Cl.$^{7}$ ..... B63H 25/42
(52) U.S. Cl. ..... 440/75
(58) Field of Search ..... 440/58, 75, 53; 474/113

(56) References Cited

U.S. PATENT DOCUMENTS 2,809,605 A * 10/1957 Russell 5,178,566 A * 1/1993 Stojkov et al. ..... 440/75

* cited by examiner

*Primary Examiner*—Ed Swinehart
(74) *Attorney, Agent, or Firm*—Robert W. Jenny

(57) ABSTRACT

The propeller drive is installed with its drive shaft inside a boat hull and its driven (propeller) shaft outside. The shafts are interconnected by a timing chain. The drive shaft position is adjustable to adjust the distance between it and the driven shaft, thus adjusting tension in the chain. The drive shaft is carried in two bearings installed in two bearing carriers. The carriers are adjustably mounted on a drive shaft casing and are structurally interconnected. The adjustments are made by mechanical adjustment of the position of the interconnecting structure relative to the casing.

7 Claims, 3 Drawing Sheets

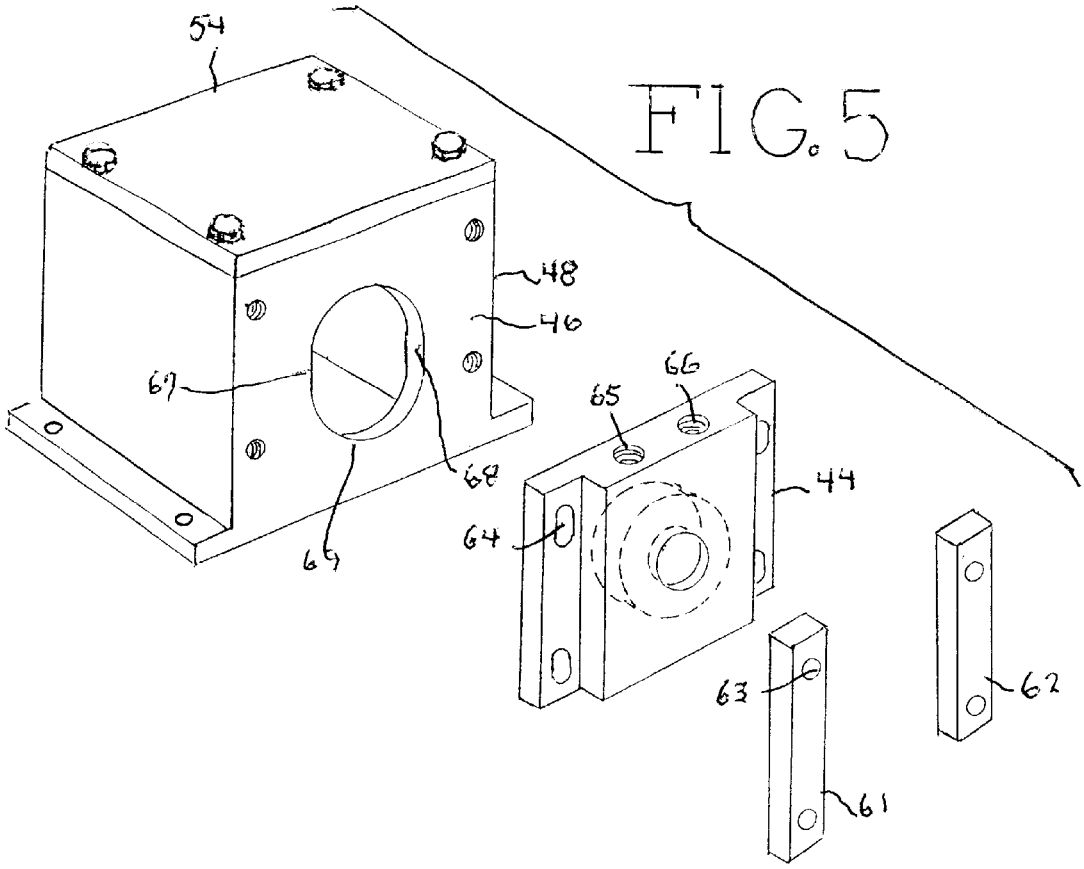
FIG. 5
FIG. 6
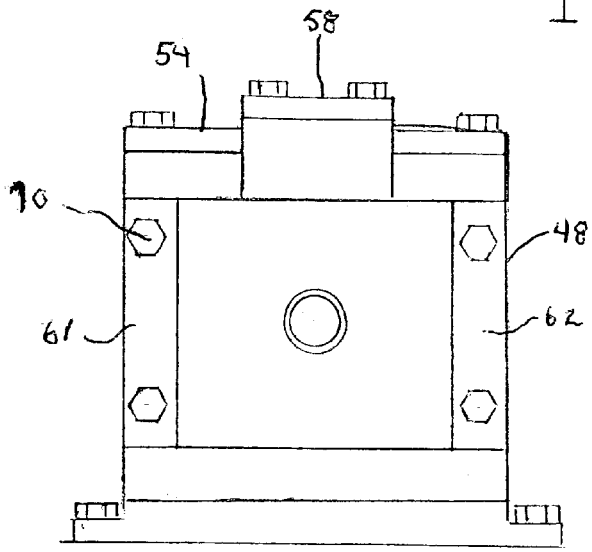

LOW FRONTAL AREA, INBOARD, THROUGH-HULL PROPELLER DRIVE

BACKGROUND OF THE INVENTION

FIELD: The subject invention is in the field of mechanical power transmission and transfer mechanisms, particularly the field of power transfer from an engine in a boat to the propeller driven by the engine. More particularly it is in the field of such drives in which the drive shaft and propeller shaft are parallel and essentially horizontal such as in well known inboard/outboard drives in which power is transmitted through the stem of a boat above the waterline and then down to the propeller shaft and propeller. However, the subject drive is an inboard drive which transmits power through the bottom of the boat. A feature common to inboard/outboard drives and similar inboard drives is that the drive shaft and propeller shaft are parallel and power is transmitted between the two using bevel and/or miter gearing, chains or belts. One important objective of such drives is that the components in the water present as low frontal area as possible to minimize drag losses. This is particularly important for sailboats in which the propeller is an auxiliary power source and must present minimum drag when the boat is under sail. The problem is more severe for larger boats in which auxiliary power levels are in the range of 100 to 200 H.P. Since such boats are not high speed boats, propeller speeds must be relatively low and propellers fairly large to achieve satisfactory efficiency. These facts require that the torque capacity of the drive be high relative to the horsepower level. In the stated horsepower range high torque per horsepower gear drives become bulky and require undesirably large frontal areas under water and, for assembly reasons, their casings comprise several parts, in many cases having long parting lines. Chain drives are better suited to high torque per horsepower transmissions; however good operation, efficiency and long life of chain drives, particularly bi-directional drives, requires that the chains be under tension and correspondingly free of slack and running in a straight line from sprocket to sprocket. It is close to physically impossible and economically and practically impossible, using conventional techniques, to design and assemble a chain drive in which the chain is always in tension without using some sort of tensioning device. This is caused in large part by the fact that use invariably involves wearing in and wear which allow the chain(s) to go slack. Tensioning devices inherently tend to add undesirable amounts of frontal area and complication.

PRIOR ART: There is much prior art in the particular field described above and many of the prior art drives use chains. The U.S. patents listed here are typical examples:

1. 2,809,605
2. 3,403,655
3. 3,795,219
4. 3,951,096
5. 4,645,463
6. 4,869,692
7. 4,887.983
8. 4,925.413
9. 4,932,907
10. 4,992,066
11. 5,813,887
12. 5,961,358
13. 6,413,127

As background to discussion of this prior art, it is important to state that the chains having the highest power capacity for their size and weight are chains known as silent chains. These chains comprise pluralities of flat links having a tooth form at each end. The side-by-side links are pinned end to end so that the teeth forms form teeth when the chain is in contact with the sprockets on which it is mounted. Belt width is determined by the numbers of links pinned side-by-side. Making and using these chains as mechanically efficiently as possible resulted in their having the characteristics that (1) they allow only limited bending in the direction away from the toothed side of the belt, and (2) the durability and efficiency depend on their being as straight as possible between sprockets at all times. These factors relate to the need for tension adjustment and prohibit techniques using tension idlers which would not allow the chain to be straight between sprockets.

Regarding the cited prior art, patents 2, 5, 6, 7, 8, 9 and 10 utilize roller chains and show no specific means for adjusting tension except in patents 1 and 10. The adjustment in patent 1 is accomplished by adjusting the distance between the drive and driven shafts by having the shafts in separate assemblies which fit together telescopically. It is judged that making the housings telescopic is not an economically efficient technique and is mechanically cumbersome. The means shown in patent 10 comprises an oval shaped cam pivotally mounted midway between the lengths of chain between sprockets so that rotating the cam in one direction so that the cam ends contact the chain lengths spreads them apart to increase tension. This does not allow the chain in tension to be straight. Also, this means can only be used in unidirectional drives. With rotation in the wrong direction the cam would be forcefully rotated into the chain and jammed.

The remaining patents show drives using belts of some kind. Patent 2 uses a toothed belt and shows no means of adjusting tension even for the purpose of removing and installing the belt. Patent 3 also shows the use of a toothed belt with means for adjusting tension for the purpose of removing and installing the belt but none for compensating for belt stretch and other factors which are known to cause loosening of toothed belts. The means used comprise a spherically mounted bearing on one end of the drive shaft so that when the housing is disassembled and the bearing at the other end of the drive shaft is removed, the shaft can drop to an angle sufficient to allow the teeth on the belt to clear the rim on the sprocket, thus facilitating removal and replacement. The end of the shaft freed by dismantling the casing is tapered to facilitate its reentry into the bearing when the case is assembled, leveling the drive shaft again and providing nominally acceptable belt tension. However, this adjustment feature does not allow compensation for belt stretch and other factors which are known to cause belt loosening. Also, to enable replacement of this belt the casing is divided vertically into forward and aft parts, generating a need for long parting surfaces and a plurality of fasteners are needed to assemble the casing.

Patent 4) shows the use of dual toothed belts. There are no provisions for tension adjustment and the method of assembly and disassembly of the belt drive is not disclosed.

Many motorcycles transmit driving power from a drive shaft to a driven shaft, the rear axle. Chain tension is adjusted by adjusting the position of the rear axle and everything carried by it relative to the drive shaft. This technique cannot be used in propeller drives because the driven shaft must be enclosed in a housing.

The closest prior art for the subject invention is disclosed in U.S. patent application Ser. No. 09/883,455, filed Jun. 18, 2001, now allowed and titled: "Low Frontal Area, Inboard Thru-Hull Propeller Drive and Methods For Assembling and Adjusting the Drive" and invented by the inventor of the subject invention. In this drive the driving shaft is in one subassembly and the driven propeller shaft in another subassembly. Chain tension is adjusted by adjusting the space between the two subassemblies and sealing means are provided to seal the gap between the assemblies while accommodating the variation in gap width.

In view of this prior art, the objective of the subject invention is to provide a low frontal area, inboard, through-hull propeller drive for power ranging up to 200 H.P. at maximum propeller shaft speeds of 2500 RPM, the drive using a silent chain and having (1) a housing having a minimum number of parts and short parting lines, (2) simple means for adjusting chain tension for installation and removal purposes and compensation for wear, (3) allowing simple chain installation and removal, and (4) using simple conventional scaling techniques.

SUMMARY OF THE INVENTION

The subject invention is a low frontal area, inboard, through-hull propeller drive. The drive comprises (1) a lower subassembly having a casing having a high fineness ratio streamlined cross section shape strut and a propeller shaft, chain sprocket and bearings installed in its lower end through the opening for the propeller shaft and its bearings, (2) an upper subassembly attached to the upper end of the lower subassembly, having a drive shaft, sprocket and bearings installed in it, and (3) a silent chain interconnecting the sprockets, which are of the same diameter, in the lower and upper subassemblies The drive shaft and sprocket are carried in the upper assembly on two bearings, each of which is carried in a bearing carrier adjustably attached to the exterior of an end of the drive casing. The bearing carriers are structurally interconnected and chain tension is adjusted by adjusting the interconnected carriers up and down on the drive casing. Sealing is provided by face seals, such as O-rings, between the surfaces of the bearing carriers and the ends of the casing.

The assembly procedure is to install the chain in the lower subassembly and attach the casing of the upper subassembly to the upper end of the lower assembly with the chain ends extending into the casing. The drive shaft and sprocket are inserted into the casing and the chain ends are connected using the slack available because the bearings and carriers are not yet installed. Then the bearings and carriers are installed and the carriers are structurally interconnected to coordinate their adjustment movement relative to the casing. The chain tension is adjusted by moving the shaft, sprocket and bearings toward and away from the lower assembly using threaded means acting between the shaft, sprocket, bearing carriers, bearings and the interconnecting structure and the top of the casing.

The invention is described in more detail below with reference to the attached drawings.

BRIEF DESCRIPTION OF THE DRAWINGS

FIG. 5 is an exploded view showing details of the upper subassembly casing, a bearing carrier and clamp bars.

FIG. 6 is an end view of the upper subassembly, the end views being identical.

DETAILED DESCRIPTION OF THE INVENTION

Figure 1:
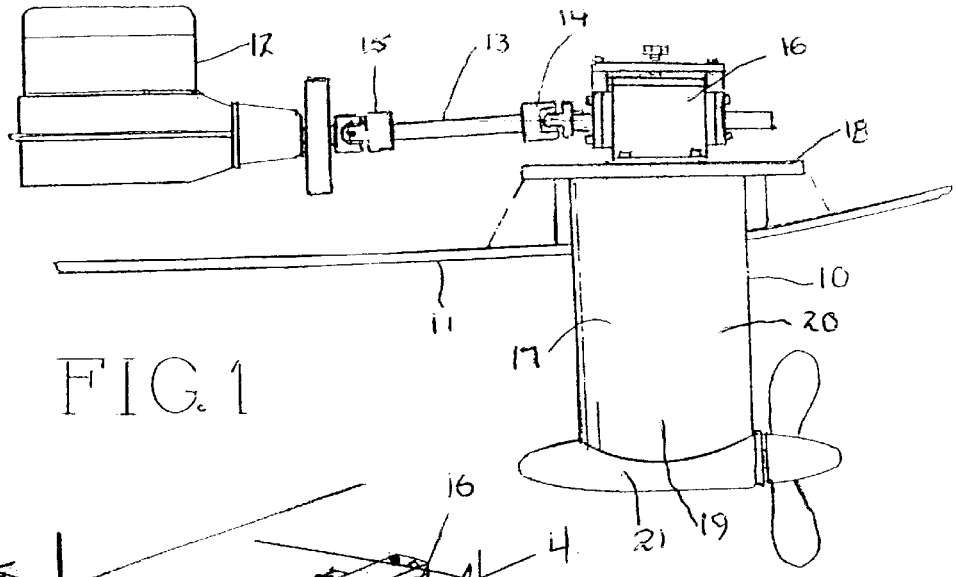
FIG. 1 is a schematic illustration of the subject drive installed in a boat.

The subject invention is a low frontal area, inboard, through-hull propeller drive. FIG. 1 illustrates schematically drive 10 mounted in boat 11 and powered by engine 12. The engine is connected to the drive by a shaft 13 with universal joints 14 and 15 at each of its ends. This arrangement allows for angular and linear misalignment of the engine and drive. The drive comprises an upper subassembly 16 and a lower subassembly 17. The lower subassembly comprises a mounting plate 18 and a lower subassembly casing 19. Casing 19 comprises, in one piece, strut 20 and propeller shaft pod 21.

Figure 2:
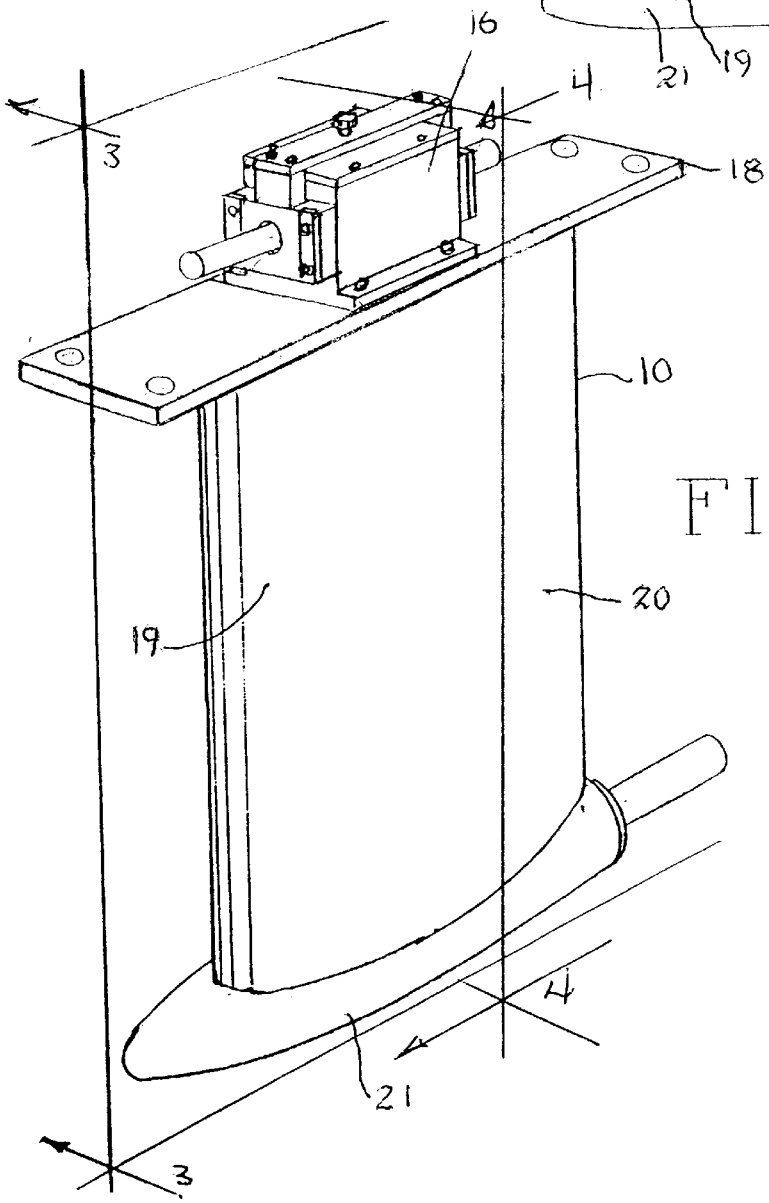
FIG. 2 is a general view of the subject drive.
Figures 3, 4:
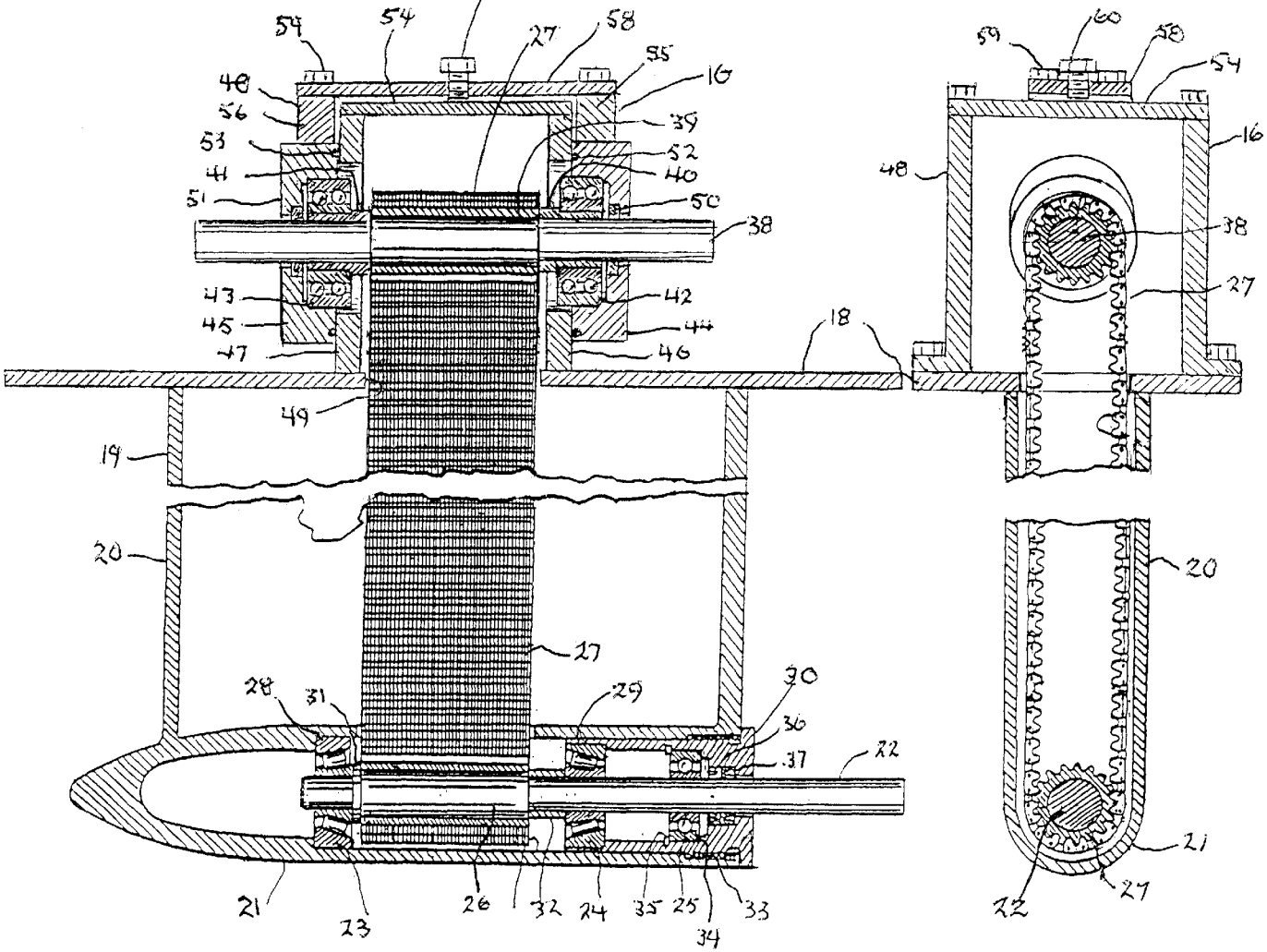
FIG. 3 is a sectional view taken at 3—3 in FIG. 2.
FIG. 4 is a sectional view taken at 4—4 in FIG. 2.

FIG. 3 is a sectional view taken at 3—3 in FIG. 2 with parts numbered as in FIG. 2. Propeller shaft 22 is carried in bearings 23, 24 and 25 and carries drive sprocket 26 driven by chain 27. Bearing 23 fits in bore 28. Bearing 24 is carried in bore 29 in fitting 30. The sprocket is spaced from bearing 23 by flange 31 and from bearing 24 by spacer 32. Fitting 30 threads into pod 21 at 33 and carries bearing 25, held in place against shoulder 34 by snap ring 35, and seals 36 and 37. Seal 36 seals lubricant oil in the drive and seal 37 seals sea water out.

The upper subassembly 16 is symmetrical about its mid length plane perpendicular to the axis of drive shaft 38 which carries drive sprocket 39 and chain 27. The shaft is supported by bushings 40 and 41 and bearings 42 and 43. The bearings are carried in bearing carriers 44 and 45 which are adjustably attached to ends 46 and 47 of upper subassembly casing 48 and explained later. The casing is attached to the top plate of the lower subassembly and chain 27 extends through opening 49 in the top plate. Seals 50 and 51 prevent oil leakage around the drive shaft and seals 52 and 53 prevent leakage between the casing ends and the bearing carriers. Casing 48 has a cover 54. The bearing carriers are structurally interconnected by spacers 55 and 56 and beam 58 and related fasteners, fastener 59 being typical. Cap screw 60 is installed at the center of the beam with its end contacting cover 54. With the bearing carriers adjustably attached as explained below, tightening screw 60 lifts the bearings carriers, bearings, drive shaft and sprocket upward, adjusting tension in the chain. Loosening screw 60 relieves tension in the chain.

FIG. 4 is a sectional view taken at 4—4 in FIG. 2 and has parts numbered as in FIG. 3.

FIG. 5 is an exploded view showing details of the upper subassembly casing and a bearing carrier numbered as in FIG. 3 plus camp bars 61 and 62. The bearing carrier and a bearing installed in it are attached by screw fasteners (not shown in this view) which extend through the holes, hole 63 being typical, in the clamp bar, the oblong holes, hole 64 being typical, in the carrier and engaging the threaded holes in the casing. Because of the oblong holes the carrier and bearing (not shown) can be adjusted when the fasteners are loosened enough as allowed by the oblong holes to adjust tension in the chain. Threaded holes 65 and 66 accept the threaded fasteners (shown in FIG. 6) which attach the structure which interconnects the carriers (described above). The bearing in the carrier, as shown in FIG. 3, extends from the carrier and engages the straight portions 67 and 68 of oblong hole 69 to help locate the carrier and bearing laterally.

FIG. 6 is an end view of the upper subassembly, the end views being identical. Parts are numbered as in other views and the threaded fasteners, fastener 70 being typical, for holding the clamp bars and bearing carrier in place are shown.

It is considered to be understandable from this description that the subject invention meets its objectives. It provides a low frontal area, inboard, through-hull propeller drive using a silent chain, the drive having a minimum of parts, short parting lines, simple means for adjusting chain tension, simple chain installation and removal and simple, conventional sealing techniques.

It is also considered to be understood that while one embodiment of the invention is shown, other embodiments and modifications of the one described are possible within the scope of the invention which is limited only by the attached claims.

I claim:

1. A through-hull inboard propeller drive comprising:

an upper subassembly, a lower subassembly, a drive shaft, a driven shaft, a chain, a drive sprocket, a driven sprocket said upper and lower subassemblies being connected, said drive sprocket being mounted on said drive shaft, said drive shaft and drive sprocket being carried in said upper subassembly, said driven sprocket being mounted on said driven shaft, said driven shaft and driven sprocket being carried in said lower subassembly, said chain interconnecting said drive and driven sprockets, said drive and driven sprockets being a distance apart and parallel, said upper subassembly further comprising apparatus for adjustment of said distance, said drive and driven shafts being constrained to remain parallel during said adjustment of said distance and being parallel when said adjustment is complete.

2. The propeller drive of claim 1 in which said upper subassembly comprises a casing having first and second ends, first and second bearing carriers, first and second bearings and structure for interconnecting said first and second bearing carriers, said first bearing being installed in said first bearing carrier, said second bearing being installed in said second bearing carrier, said first bearing carrier being adjustably installed on said first end, said second bearing carrier being adjustably installed on said second end, said structure for interconnecting being installed to interconnect said first and second bearing carriers, said drive further comprising apparatus for adjusting, said apparatus for adjusting including at least one screw installed in said structure for interconnecting, operation of said at least one screw causing equal adjustment of said structure for interconnecting, said bearing carriers, said bearings, said drive shaft and said drive sprocket to adjust tension in said chain, said drive shaft remaining parallel to said driven shaft during said adjustment.

3. The propeller drive of claim 2 in which said first and second ends are parallel to each other and perpendicular to said drive and driven shafts, said structure for interconnecting holds said first and second bearing carriers against said first and second ends, restricting angular displacement of said drive shaft and constraining it to remain parallel to said driven shaft during adjustment.

4. The propeller drive of claim 2 in which said drive further comprises a top of said casing and said means for adjusting further comprises at least one threaded hole in said interconnecting structure, said at least one screw being installed in said threaded hole and contacting said top.

5. The propeller drive of claim 1 in which said apparatus for adjusting is accessible and operable without disassembly of said drive.

6. The propeller drive of claim 2 in which said apparatus for adjusting is accessible and operable without disassembly of said drive.

7. The propeller drive of claim 3 in which said apparatus for adjusting is accessible and operable without disassembly of said drive.

* * * * *